US005413235A

United States Patent [19]

Decelles

[11] Patent Number: 5,413,235

[45] Date of Patent: May 9, 1995

[54] TAMPER-EVIDENT CLOSURE

[76] Inventor: Gilles Decelles, P.O. Box 1197, Waterloo, Québec, Canada, J0E 2N0

[21] Appl. No.: 314,010

[22] Filed: Sep. 28, 1994

[51] Int. Cl.[6] ..... B65D 41/34

[52] U.S. Cl. ..... 215/252

[58] Field of Search ..... 215/252, 256

[56] References Cited

U.S. PATENT DOCUMENTS

| | | | |
|---|---|---|---|
| 4,478,343 | 10/1984 | Ostrowsky | 215/252 |
| 4,530,437 | 7/1985 | Gray et al. | 215/252 |
| 4,550,844 | 11/1985 | Lininger | 215/252 |
| 4,595,110 | 6/1986 | Herr | 215/252 |
| 4,597,500 | 7/1986 | Stubbs | 215/256 |
| 4,801,030 | 1/1989 | Barriac | 215/252 |
| 4,807,771 | 2/1989 | Roy et al. | 215/252 |
| 4,899,898 | 2/1990 | Thompson | 215/252 |
| 4,919,286 | 4/1990 | Agbay, Sr. | 215/235 |
| 4,957,211 | 9/1990 | Ekkert et al. | 215/230 |
| 4,978,017 | 12/1990 | McBride | 215/252 |
| 4,984,701 | 1/1991 | Margaria | 215/256 |
| 5,007,545 | 4/1991 | Imbery, Jr. | 215/14 |
| 5,131,550 | 7/1992 | Thompson | 215/252 |
| 5,197,619 | 3/1993 | Margaria | 215/256 |

FOREIGN PATENT DOCUMENTS

| | | |
|---|---|---|
| 0308995 | 3/1989 | European Pat. Off. . |
| 0337046 | 10/1989 | European Pat. Off. . |
| 0553685 | 8/1993 | European Pat. Off. . |
| 4108453 | 10/1991 | Germany . |
| 6703140 | 9/1967 | Netherlands . |
| WO90/11944 | 10/1990 | WIPO . |

*Primary Examiner*—Gary E. Elkins
*Assistant Examiner*—Nova Stucker
*Attorney, Agent, or Firm*—Robic

[57] ABSTRACT

The closure comprises a cap portion and a ring portion. The cap portion has a top wall and an annular skirt. The ring portion comprising an upper ring, a lower ring and a plurality of inwardly oriented wedges positioned between the upper and lower ring. The ring portion is connected to the lower edge of the skirt so as to be easily breakable. The plurality of inwardly oriented wedges are circumferentially distributed and spaced apart from each other between the upper and lower ring. Each wedge has an upper and lower edge connected along a thin folding lines to the lower and upper ring. Each wedge also has an inwardly and upwardly projecting apex positioned and sized to fit under the outwardly extending flange of the threaded neck portion of the container when the cap portion of the closure is fully screwed onto the threaded neck portion. In use, when the closure is screwed onto the container, the wedges are allowed to move radially outwardly thanks to the thin folding lines joining the wedges to upper and lower ring and thus the wedges pass over the flange of the neck. Then, the wedges return to their original position where the apexes extend under the flange. As soon as someone tries to remove the closure, the apexes of the wedges engage the flange of the neck and get lock onto the same, thereby causing the ring portion to separate from the skirt of the cap portion and fall, thereby providing an indication that the container has been open.

9 Claims, 4 Drawing Sheets

TAMPER-EVIDENT CLOSURE

FIELD OF THE INVENTION

The present invention relates to a tamper-evident closure.

BACKGROUND OF THE INVENTION

Tamper-evident closures of various types and designs are well known devices that are used on containers to provide an indication to the consumer that the container has been open. Such closures generally include a cap portion and a security ring portion connected to the lower edge of the cap portion by a failure line. Typically the ring portion of the closure comprises a plurality of tabs extending upwardly and inwardly so as to abut against an annular flange that is part of the neck of the container after the closure has been screwed in sealing position. As soon as someone tries to remove the closure from the container, the failure line breaks and causes the ring portion to separate from the cap portion and thus give a visual indication that the container has been open. Closures of this type are described, by way of examples in U.S. Pat. Nos.

4,478,343
4,550,844
4,595,110
4,801,030
4,807,771
4,978,017
5,007,545

As can be easily understood, it is desirable for the tamper-evident closures to be easily manufacturable at low cost and be versatile for use with a large variety of containers.

It is also desirable to obtain a tamper-evident closure where the connection between the cap portion and the ring portion is more resilient upon screwing so as to facilitate installation of the closure onto the container. Another advantage sought in the conception of tamper-evident closures is the obtention of a closure which allows the failure line to break easily when someone tries to unscrew the closure.

SUMMARY OF THE INVENTION

The object of the present invention is to provide a tamper evident-closure that satisfies these needs.

More particularly the invention provides a tamper-evident closure for sealing a container, which have an opening, a threaded neck portion and an outwardly extending annular flange, the flange being adjacent to and beneath the threaded neck portion.

This tamper-evident closure comprises a cap portion and a ring portion.

The cap portion is sized to fit and be screwed onto the threaded neck portion of the container. It has a top wall and an annular skirt of given internal diameter that is coaxial with and integrally projects from the top wall. The skirt has a lower edge and is provided with an internal thread sized and shaped to engage the threaded neck portion of the container. In one embodiment of the invention, the skirt also has a generally cylindrical exterior wall provided with a plurality of gripping ribs.

The ring portion which is coaxial with the top wall and the skirt of the cap portion comprises an upper ring, a lower ring and a plurality of inwardly oriented wedges positioned between the upper and lower ring.

The upper ring has the same internal diameter as the skirt. It also has an upper edge and a lower edge, the upper edge being connected to the lower edge of the skirt by breakable connecting means. In a preferred embodiment of the invention, the connecting means comprises a plurality of frangible break-away bridges attaching the upper edge of the upper ring to the lower edge of the skirt. Between each pair of bridges, the upper edge of the upper ring can be provided with an axially extending protrusion which terminates short of the lower edge of the skirt. The protrusions are adapted to engage the lower edge of the skirt on application of an axial force to the closure during installation and thus, to protect the bridges from premature breakage.

The lower ring has the same internal diameter as the skirt, and it also has an upper edge and a lower edge.

The plurality of inwardly oriented wedges are circumferentially distributed and spaced apart from each other in between the upper and lower ring. Each wedge has an upper edge connected along a thin folding line to the lower edge of the upper ring. It also has a lower edge connected along another thin folding line to the upper edge of the lower ring. And finally each wedge has an inwardly and upwardly projecting apex positioned and sized to fit under the outwardly extending flange of the threaded neck portion of the container when the cap portion of the closure is fully screwed onto the threaded neck portion.

In use, when the closure is screwed onto the container to close the same, the wedges are allowed to move radially outwardly thanks to the thin folding lines joining the wedges to upper and lower ring and thus the wedges pass over the flange of the neck. Then, the wedges return to their original position where the apexes of the wedges extend under the flange.

If or when someone tries to remove the closure, the apexes of the wedges engage the flange of the neck and get lock onto the flange, thereby causing the connecting means to break and the ring portion to fall.

The tamper-evident closure according to the invention may further comprise a disc-shaped liner having substantially the same diameter as the opening of the container. This disc-shaped is nested against the inside surface of the top wall after cap portion so as to form a seal between the closure and the opening of the container.

In another preferred embodiment of the invention, the cap portion and the ring portion have an identical external diameter, and are integral to each other and made of thermoplastic.

A non restrictive description of a preferred embodiment will now be given with reference to the appended drawings.

DESCRIPTION OF A PREFERRED EMBODIMENT

The tamper-evident closure 10 according to the invention as shown in the accompanying drawings is intended to be used for sealing a container 40.

Figure 1:
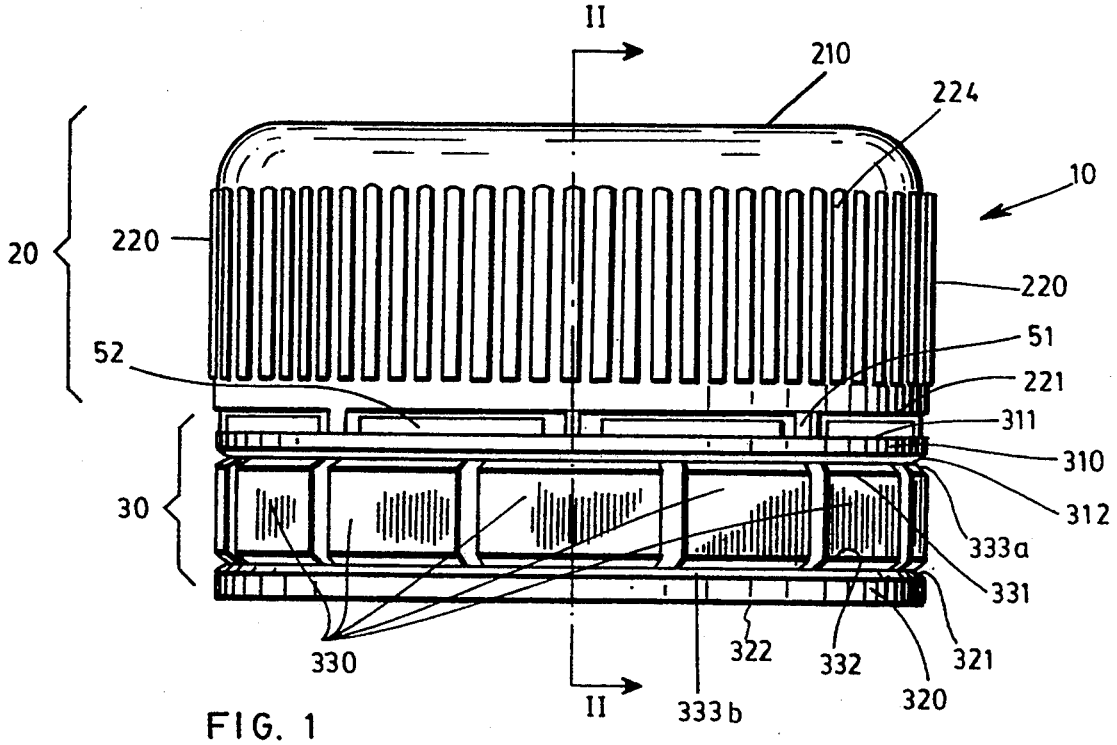
FIG. 1 is a side elevational view of a tamper-evident closure according to the invention.
Figure 2:
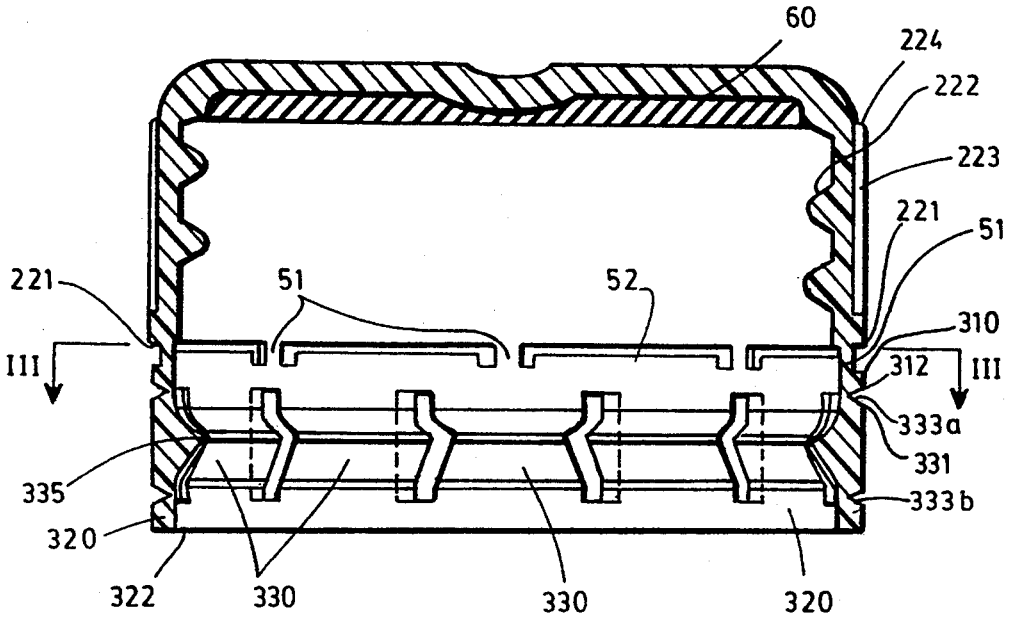
FIG. 2 is a cross-sectional view taken along line II—II of FIG. 1.
Figure 3:
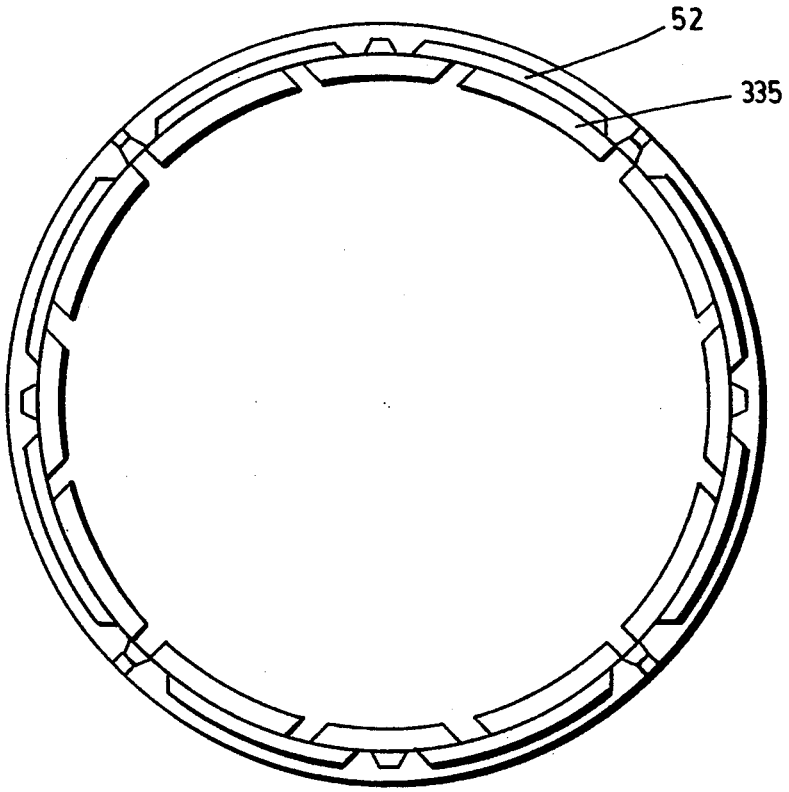
FIG. 3 is a cross-sectional view taken along line III—III of FIG. 2.
Figure 4:
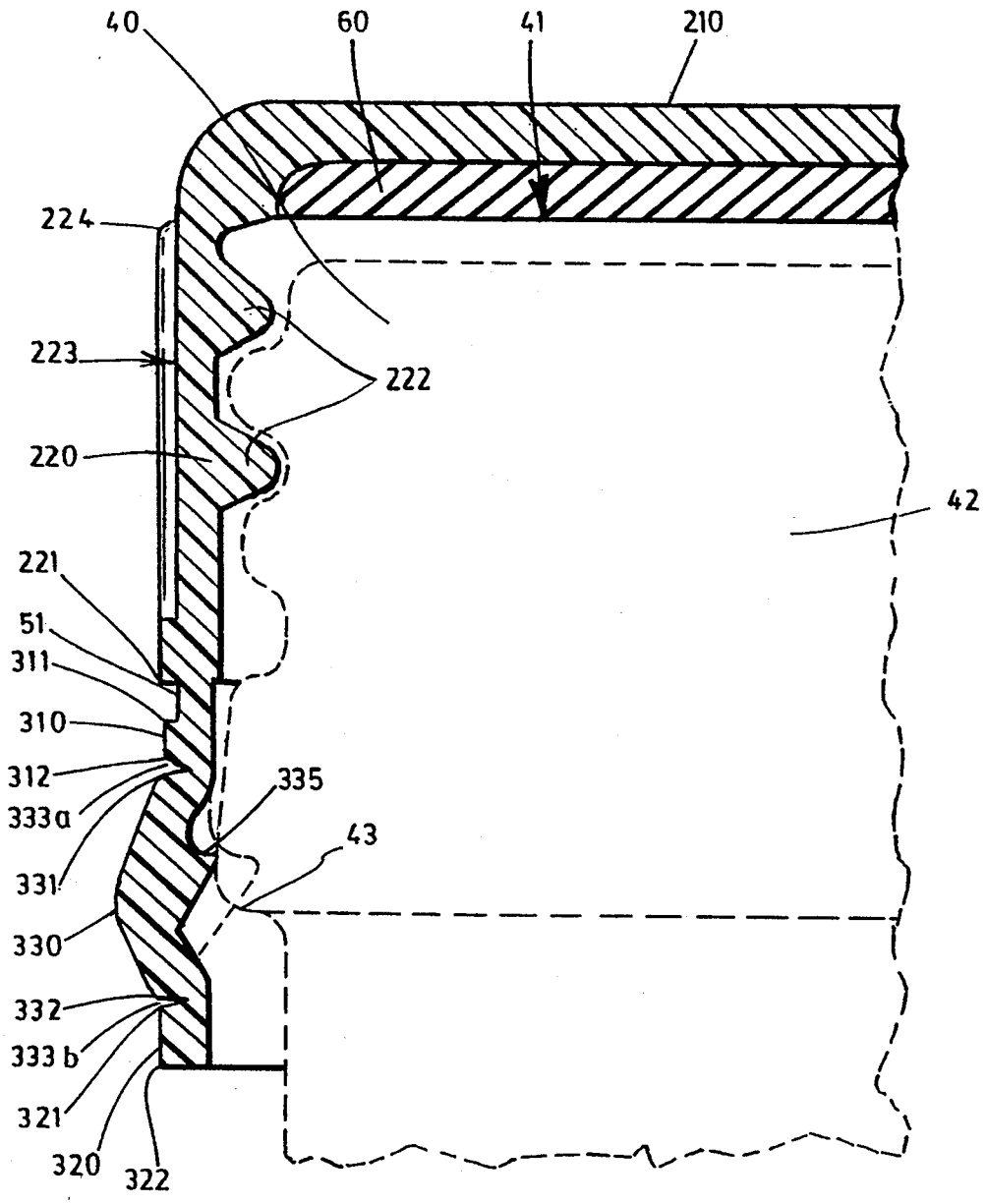
FIG. 4 is a enlarged fragmentary, cross-sectional view of the closure of FIG. 1, where the same is inserted onto the neck of a container to be closed.
Figure 5:
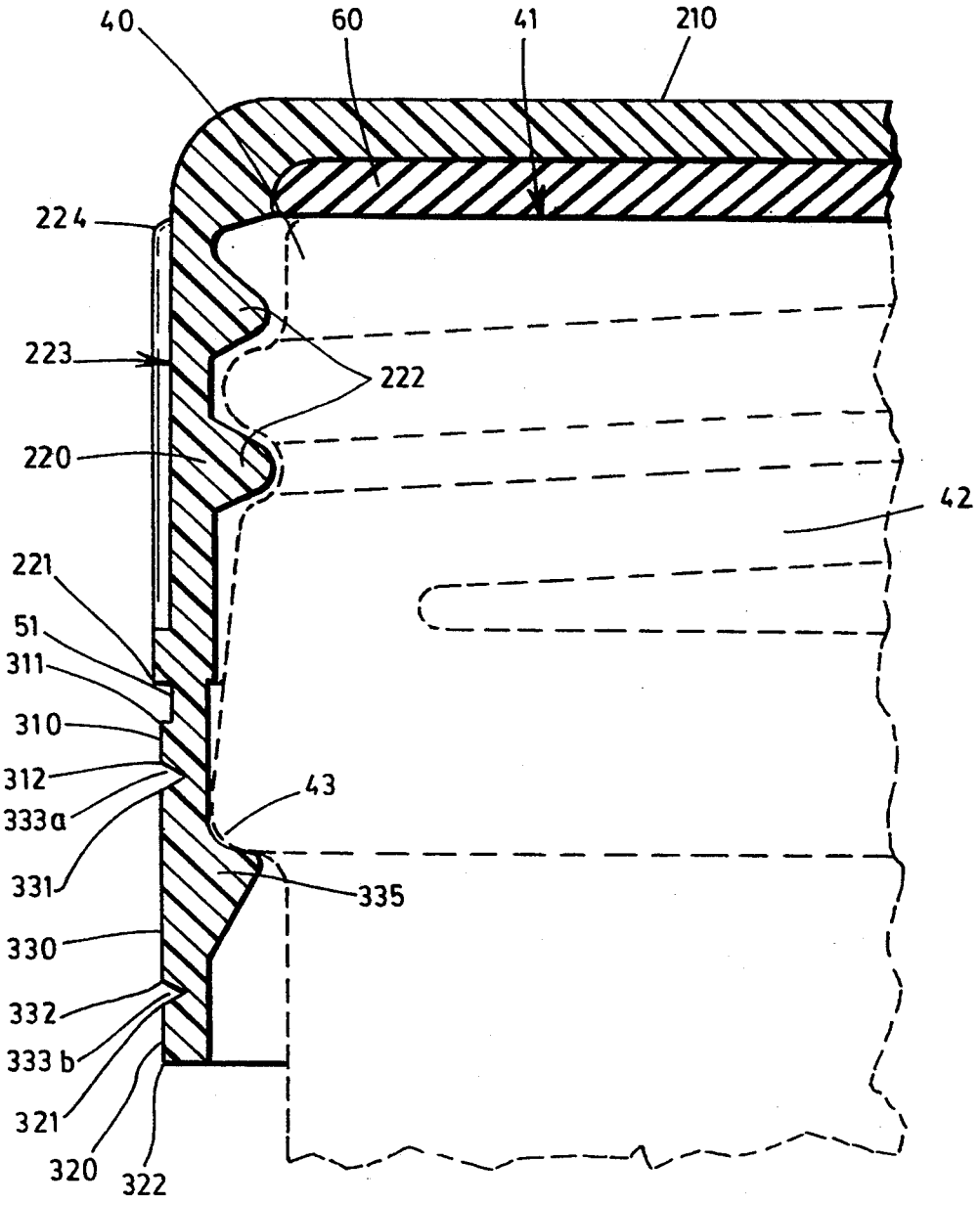
FIG. 5 is a view similar to FIG. 4, showing the closure in installed in installed position onto the neck of the container.

The container 40 which is shown in FIG. 4 and 5 comprises an opening 41, a threaded neck portion 42 and an outwardly extending annular flange 43 adjacent to and beneath the threaded neck portion 42. This basic structure is rather conventional and needs not be further described.

The closure 10 comprises a cap portion 20 and a ring portion 30.

The cap portion 20 is sized to fit and be screwed onto the threaded neck portion 42 of the container 40, as shown in FIG. 4 and 5. It has a top wall 210 and an annular skirt 220 of given internal diameter that is coaxial with and integrally projects from the top wall 210. The skirt 220 has a lower edge 221 and is provided with an internal thread 222 sized and shaped to engage the threaded neck 42 portion of the container 40. In the illustrated embodiment of the invention, the skirt 220 also has a cylindrical exterior wall 223 provided with a plurality of gripping ribs 224. Once again, this basic structure is conventional and needs not be further described.

In accordance with a very important aspect of the invention, the ring portion 30 which is coaxial with the top wall 210 and the skirt 220 of the cap portion 20 comprises an upper ring 310, a lower ring 320 and a plurality of inwardly oriented wedges 330 positioned between the upper 310 and lower ring 320. The cap portion and the ring portion can have an identical external diameter as shown in FIG. 1–5.

The upper ring 310 has the same internal diameter "d" as the skirt 220. It also has an upper edge 311 and a lower edge 312, the upper edge 311 being connected to the lower edge of the skirt 221 by breakable connecting means 51 of conventional structure. In the illustrated embodiment of the invention, these connecting means 51 preferably consist of plurality frangible of breakaway bridges attaching the upper edge 311 of the upper ring 310 to the lower edge 221 of the skirt 220.

The lower edge 221 of the skirt 220 and the upper edge 311 of upper ring 310 are also provided with a plurality of axially extending, circumferentially spaced protrusions 52. Each of protrusion 52 terminates short of the other one of the edges and is adapted to engage the other edge on application of an axial force to the closure during installation and thus, to protect the bridges from premature breakage. Preferably, there is a protrusion 52 between each pair of bridges 51, these protrusions 52 extending from the upper ring 310.

In another not illustrated embodiment, the connecting means 51 may comprise a portion of substantially reduced cross sectional thickness, such as a groove.

The lower ring 320 has the same internal diameter as the skirt 220, and it also has an upper edge 321 and a lower edge 322.

As illustrated, the inwardly oriented wedges 330 joining the upper and lower rings are circumferentially distributed and spaced apart from each other in between the upper 310 and lower ring 320. Each wedge 330 has an upper edge 331 connected along a thin folding line **333*a* to the lower edge 312 of the upper ring 310. It also has a lower edge 332 connected along another thin folding line 333*b* to the upper edge 321 of the lower ring 320. Each wedge 330 further has an inwardly and upwardly projecting apex 335 positioned and sized to fit under the outwardly extending flange 43 of the threaded neck portion 42 of the container 40 when the cap portion 20 of the closure 10 is fully screwed onto the threaded neck portion 42, as shown in FIG. 5**.

In use, when the closure 10 is screwed onto the container 40 to close the same as shown in FIG. 4, the wedges 330 are allowed to move radially outwardly thanks to the thin folding lines **333*a* and 333*b* joining the wedges 330 to upper 310 and lower ring 320. This allows the wedges 330 to pass over the flange 43 of the neck 42. Then, the wedges 330 return to their original position where the apexes 335 extend under the flange 43, as shown in FIG. 5**, and get locked there.

As soon as someone tries to remove the closure 10 to open the container, the apexes 335 of the wedges 330 engage the flange 43 of the neck 42 and get lock onto flange 43, thereby causing the connecting means 51 to break and the ring portion 30 to fall.

As illustrated the closure 10 may also comprise a disc-shaped liner 60 having substantially the same diameter as the opening 41 of the container 40. This disc-shaped liner 60 nests against the inside surface of the top wall 210 of the cap portion 20 and thus forms a seal between the closure 10 and the opening 41 of the container 40.

Preferably, the cap portion 20 and the ring portion of the closure are integral to each other and made of thermoplastic material. Such is well known in the art and needs not to be further described.

Although a preferred embodiment of the invention has been described in detail herein and illustrated in the accompanying drawings, it is to be understood that the invention is not limited to this precise embodiment and that various changes and modifications may be effected therein without departing from the scope or spirit of the invention.

What is claimed is:

1. A tamper-evident closure for sealing a container, said container having an opening, a threaded neck portion and an outwardly extending annular flange adjacent to and beneath the threaded neck portion, said tamper-evident closure comprising:

(a) a cap portion sized to fit and be screwed onto the threaded neck portion of the container, said cap portion having a top wall and an annular skirt of given internal diameter that is coaxial with and integrally projects from said top wall, said skirt having a lower edge and being provided with an internal thread sized and shaped to engage the threaded neck portion of the container; and (b) a ring portion that is coaxial with the top wall and skirt of the cap portion comprising:

an upper ring having the same internal diameter as the skirt, said upper ring having an upper edge connected to the lower edge of the skirt by breakable connecting means, and a lower edge;

a lower ring of the same internal diameter as the skirt, said lower ring also having an upper edge and a lower edge; and a plurality of inwardly oriented wedges circumferentially distributed and spaced apart from each other in between said upper ring and said lower ring, each wedge having an upper edge connected along a thin folding line to the lower edge of the upper ring, a lower edge connected along another thin folding line to the upper edge of the lower ring, and an inwardly and upwardly projecting apex positioned and sized to fit under the outwardly extending flange of the threaded neck portion of the container when the cap portion of the closure is fully screwed onto the threaded neck portion, whereby, in use, when the closure is screwed onto the container to close the same, the wedges are allowed to move radially outwardly due to the thin folding lines joining said wedges to said upper ring and said lower ring, and thus pass over the flange of the neck before returning to their original position where the apexes of the wedges extend under the flange; and, thereafter, during removal of the closure, the apexes of the wedges engage under the flange of the neck, the connecting means break and the ring portion separates from said skirt.

2. A tamper-evident closure as claimed in claim 1 wherein the breakable connecting means comprises a plurality of frangible bridges attaching the upper edge of the upper ring to the lower edge of the skirt.

3. A tamper-evident closure as claimed in claim 2 wherein one of the lower edge of said skirt and the upper edge of said ring is provided with a plurality of axially extending, circumferentially spaced protrusions, each of said protrusions terminating short of the other one of said edges and being adapted to engage said other edge on application of an axial force to said closure during installation and thereby protect said bridges from premature breakage.

4. A tamper-evident closure as claimed in claim 3 comprising one of said protrusions between each pair of adjacent bridges and wherein all said protrusions extend from the upper ring.

5. A tamper-evident closure as claimed in claim 4 wherein the cap portion and the ring portion have an identical external diameter.

6. A tamper-evident closure as claimed in claim 5 wherein the annular skirt has a generally cylindrical exterior wall provided with a plurality of gripping ribs.

7. A tamper-evident closure as claimed in claim 6, further comprising a disc-shaped liner having a diameter chosen to be substantially the same diameter as the opening of the container and nesting against the inside surface of the top wall of said cap portion so as to form a seal between the closure and the opening of the container.

8. A tamper-evident closure as claimed in claim 1 wherein said cap portion and said ring portion are unitary in construction and made of thermoplastic material.

9. A tamper-evident closure as claimed in claim 7 wherein said cap portion and said ring portion are integral to each other and made of thermoplastic material.

* * * * *